US006820662B2

(12) United States Patent
Crawford et al.

(10) Patent No.: US 6,820,662 B2
(45) Date of Patent: Nov. 23, 2004

(54) VERTICAL BUBBLE DISPENSING DEVICE

(75) Inventors: Alan Dale Crawford, Burbank, CA (US); Robert A. DeMars, Woodland Hills, CA (US)

(73) Assignee: Original Ideas, Woodland Hills, CA (US)

( * ) Notice: Subject to any disclaimer, the term of this patent is extended or adjusted under 35 U.S.C. 154(b) by 174 days.

(21) Appl. No.: 10/026,316

(22) Filed: Dec. 20, 2001

(65) Prior Publication Data

US 2003/0116224 A1 Jun. 26, 2003

(51) Int. Cl.[7] ..... B65B 1/04; B65B 3/04; B67C 3/00

(52) U.S. Cl. ..... 141/319; 141/98; 141/198; 141/363; 141/364; 141/366

(58) Field of Search ..... 446/15–21; 141/18, 141/98, 102, 105, 106, 126, 192, 198, 199, 291, 319, 320, 351, 352, 363–366

(56) References Cited

U.S. PATENT DOCUMENTS

| | | | | | |
|---|---|---|---|---|---|
| 2,274,052 A | * | 2/1942 | Feder | 446/20 |
| 4,764,141 A | | 8/1988 | D'Andrade | 446/16 |
| 4,775,348 A | | 10/1988 | Collins | 446/16 |
| 4,955,840 A | * | 9/1990 | Moomaw | 446/17 |
| 5,879,218 A | | 3/1999 | Tao | 446/15 |
| 5,908,057 A | * | 6/1999 | Schramm | 141/98 |
| 6,102,764 A | * | 8/2000 | Thai | 446/15 |

OTHER PUBLICATIONS

Web Page for The lighter Side Co. Product: Pumpkin Bubble Blower I www.lighterside.com/aspfiles/itemdy.01.asp?CODIV=0125&UID=2001091918064434&T1=35917&F.

* cited by examiner

*Primary Examiner*—Timothy L. Maust
(74) *Attorney, Agent, or Firm*—Cislo & Thomas LLP

(57) ABSTRACT

A machine that makes bubbles that are dispensed vertically. A membrane-forming system forms a bubble solution membrane over a bubble ring. Air is passed through the bubble ring by a blowing fan, which is intermittently operated to allow contact between a membrane-forming ring and the bubble ring. Bubble solution is continuously supplied to the bubble rings from a central reservoir. Safety switches prevent operation of the bubble-making machine unless there is bubble solution in the reservoir, the main housing is properly connected to the fan, and the bubble machine is in an upright position (and not tipped over). The present invention provides continuous operation for the duration of the bubble solution supply, and is easily washed, used, maintained, and manufactured.

52 Claims, 5 Drawing Sheets

104
236
234
240
222
238
232
124
128
4
108
252
250
106
210
252
120
224
172
122
152

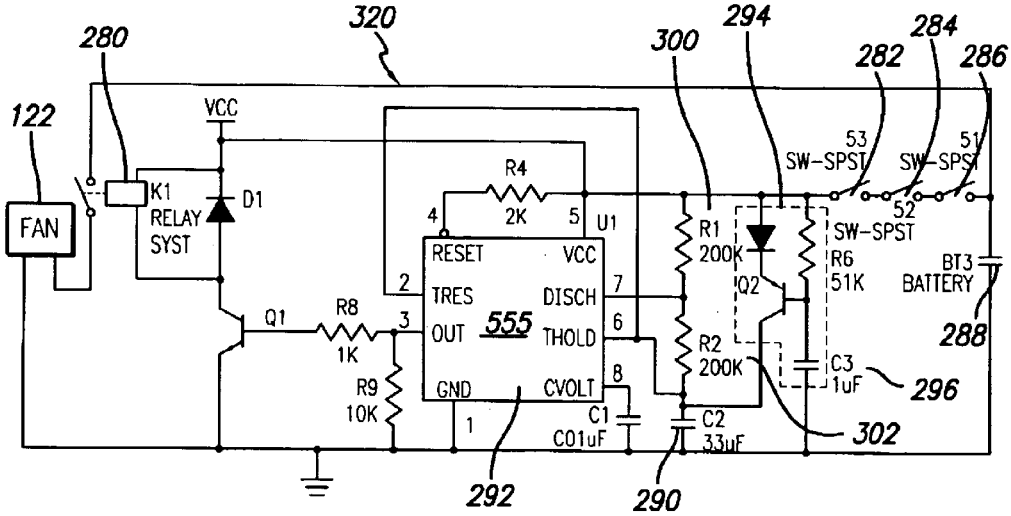
FIG. 6
FIG. 7
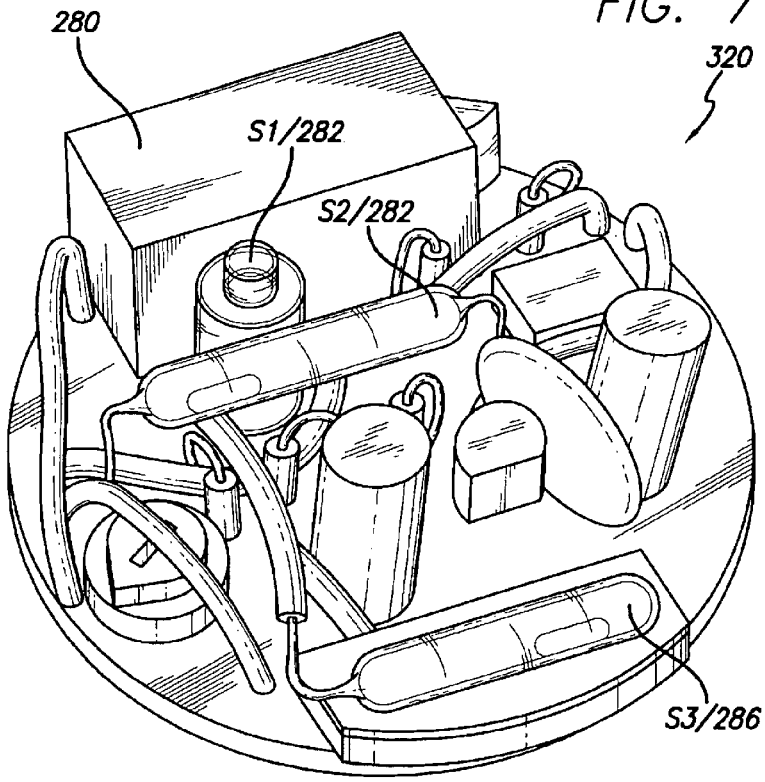

VERTICAL BUBBLE DISPENSING DEVICE

BACKGROUND OF THE INVENTION

1. Field of the Invention

This invention relates to bubble making and more particularly to a machine for making soap bubbles that are dispersed in a generally vertical manner.

2. Description of the Related Art

Bubbles made of a solution of water and soap or detergent are well known in the art, as are means by which bubbles can be produced.

Many people are familiar with the standard child's toy of a bottle of bubble solution having a bubble wand inside. A screw top lid generally keeps the wand and solution closed in the bottle, and when the child or the person wants to blow bubbles, the lid is unscrewed, the wand is removed, and the person's breath is blown through the ring, or loop, formed by the bubble wand. The bubble solution membrane adhering to the teeth of the toothed ring circumscribing the bubble wand is then stretched with the blowing breath and forms bubbles that fly away from the bubble wand. Generally, a membrane is formed across the bubble ring of the bubble wand when it is extracted from the bubble solution. If this is not so, bubbles do not form and the wand must be dipped again into the bubble solution. With practice, bubbles of several sizes may be blown from the bubble wand. The wand itself generally has a handle so that the ring may be dipped in the bubble solution without getting additional soap on the child's fingers.

Other bubble making devices are generally variations on this theme where a vertically-disposed bubble ring is supplied with bubble solution, a serrated or toothed extension extends from the bubble ring to provide additional surface area, and the initial membrane formed across the bubble ring serves as the source for bubbles when air is blown through the ring. The bubbles are generally blown horizontally from a vertically-disposed bubble ring.

This is generally the basis for a variety of devices, including a pumpkin bubble blower, Item No. 35917 of the 2001 Johnson Smith catalog where a vertical ring of several such bubble rings is rotated through a reservoir of bubble solution. A squirrel cage or other type of fan then blows air through individual rings as they travel above the reservoir and past the fan. The limited amount of soap that each of the rings can hold is then exhausted and the ring is returned into the reservoir by circular rotation. The fan is then focused upon the next bubble ring and proceeds to blow bubbles from it.

U.S. Pat. No. 5,879,218 issued to Tao and assigned to Cap Toys, Inc. for a Bubble Apparatus and Method issued Mar. 9, 1999, has a bubble making apparatus for producing bubbles from a gun like device. Bubbles are expelled from one aperture while an additional air blowing aperture serves to disperse the bubbles away from the opening to the bubble aperture.

U.S. Pat. No. 4,764,141 issued to D'Andrade on Aug. 16, 1988, for a Toy Bubble Blowing Machine has a housing that may simulate a motor and may be mounted on a rideable toy such as a bicycle or automobile. A bubble wand with a plurality of wand heads share a central hub, and a Geneva mechanism is used to sequentially rotate each of the wand heads through bubble solution and forced air in sequence.

Other machines and devices are known in the art. Many of these blow bubbles in a horizontal, and not a vertical, direction. Blowing bubbles in a vertical direction is generally not possible with these systems, as the bubble heads must be rotated through a horizontal reservoir of bubble solution and consequently must be orthogonal, or at a right angle, to such bubble solution. Tilting the machine as a whole into an upright direction would generally spill the bubble solution out of the reservoir, thereby eliminating the source of bubble solution for future bubbles from the bubble machine.

Consequently, it would be an advance in the art to provide means by which bubbles could continuously be produced and blown vertically from an on-going bubble machine. Such a device would preferably be easy to use, easy to clean, and very reliable in that it would only function if properly assembled and would cease to function if tipped over.

The present invention as set forth herein solves many of the problems present in the prior art, as well as providing additional advantages and benefits that have heretofore not been seen.

SUMMARY OF THE INVENTION

The present invention provides a machine for making soap bubbles that are dispensed and dispersed in a generally vertical manner. This is in distinction to prior art devices, which generally dispense their bubbles in a horizontal fashion.

A fan is used to blow air upwardly through a housing, which is generally closed by two flaps when air is not blown by the fan. The flaps enjoy hinged attachment with the top of the housing and are generally flush with that top. The flaps are generally light in nature so that they may be forced open by the fan-blown air. The flaps generally fit within the inner perimeter of the housing end and each has membrane-forming rings at one end. These rings engage bubble-making rings that have circumscribing toothed rings acting as bubble stabilizers.

In order to initially form a membrane across the bubble ring, the membrane-forming rings come into contact with the bubble rings and the bubble solution held in a bubble ring channel associated with the bubble rings. When withdrawn from a bubble ring, the membrane-forming ring takes bubble solution with it causing a bubble solution membrane to form over the bubble ring. The membrane formed across the bubble ring is then subject to the air blown by the fan, which has sufficient force or pressure to blow bubbles from the bubble rings.

The flaps extend upwardly from the housing and direct the blown air and the bubbles away from the bubble-making machine. While the bubble rings are continuously supplied with bubble solution from a central reservoir, the membrane sometimes ruptures and the creation of bubbles ceases, even though there is bubble solution in the bubble ring channel and air is blowing from the fan. In order to continually create a membrane across the bubble rings, the fan is intermittently turned off so that the flaps may descend towards the housing and the membrane forming rings may engage the bubble solution in the bubble ring channel. The fan then starts to blow, lifting the flaps and the membrane-forming rings, forming a membrane across the bubble ring, and creates additional bubbles.

The housing may be connected to a fan framework by a bayonet connection, and four "AA" batteries may power an intermittent timing circuit to control the intermittent operation of the fan. A standard bubble solution container often purchased at toy stores and elsewhere is fitted with a special self-closing lid that fits over a float cage to allow flow of the bubble solution into the reservoir. Vacuum pressure, much in the same way as a water dispenser, keeps the bubble solution in the bottle. The presence of bubble solution in the reservoir causes a magnetic float to lift from the bottom of the reservoir. The floating of the magnetic float closes a switch in the intermittent circuit enabling the fan to turn on. Additional switches in the intermittent circuit allow coupling of the circuit to the housing so that the proper attachment of the housing to the fan's framework is detected by the intermittent circuit. Finally, a tip-over switch is present in the intermittent circuit which when open (indicating a tip-over condition) ceases operation of the fan.

In this manner, a bubble machine dispensing bubbles in a vertical manner may be manufactured and produced in a cost-efficient, highly useful, and very efficient manner. Additionally, the enjoyment and/or merriment that can be elicited by the accompaniment of bubbles is better provided, and individuals or circumstances complemented by such activity are more easily achieved.

OBJECTS OF THE INVENTION

It is an object of the present invention to provide a bubble machine.

It is yet another object to provide a bubble machine that creates and dispenses bubbles in a vertical manner.

It is yet another object of the present invention to provide a bubble machine that can continually create bubbles, although a membrane is temporarily absent from a bubble ring.

It is yet another object of the present invention to provide a continual supply of bubble solution to bubble rings creating vertically-dispersed bubbles with reduced leakage.

It is yet another object of the present invention to create a bubble machine that is easily cleaned.

It is yet another object of the present invention to provide a bubble machine that requires little monitoring during operation.

These and other objects and advantages of the present invention will be apparent from a review of the following specification and accompanying drawings.

BRIEF DESCRIPTION OF THE DRAWINGS

FIG. 6 is an electronic circuit schematic of the intermittent circuit used to control the fan and sense proper assembly and disposition of the bubble machine in FIG. 1.

FIG. 7 is a top side perspective view of component silhouettes used to construct the circuit shown in FIG. 6 and used to control the intermittent activity of the fan.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
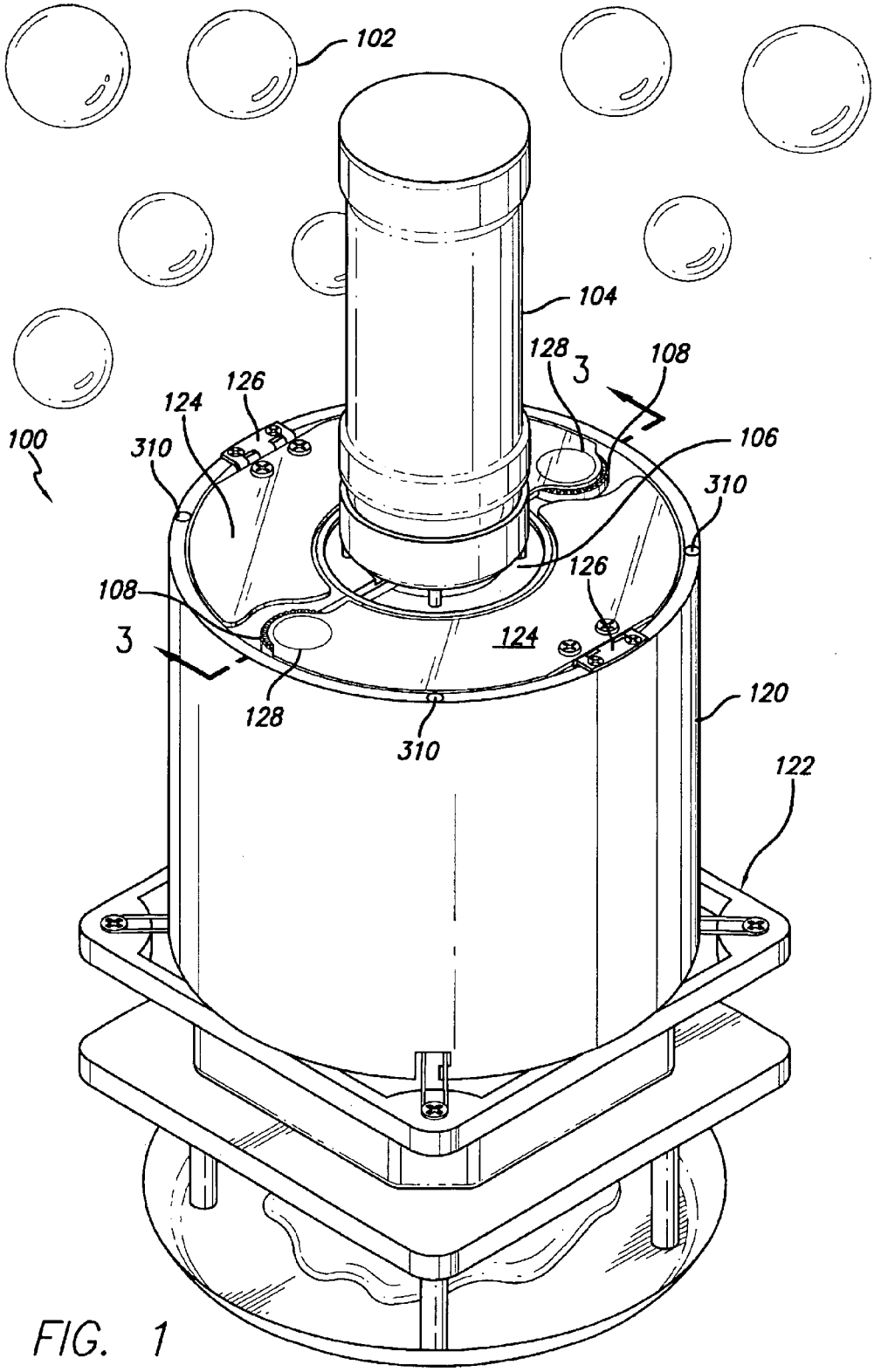
FIG. 1 is a top side perspective view of the bubble machine of the present invention with the flaps closed.

As shown in FIG. 1, the bubble machine 100 of the present invention is used to create bubbles 102 from bubble solution held in the refillable bottle 104. The refillable bottle 104 is held in the central reservoir 106 that communicates the bubble solution to the bubble rings 108. The bubble rings 108 are also known and referred to as bubble loops 108. The refillable bottle 104 operates on a known principle of inverted bottle delivery systems and is described in more detail, below. Generally, the bubble solution is a solution of soap or detergent, but other solutions or liquids may be advantageously used in the present invention.

A central housing 120 directs air blown from a fan (FIG. 5) 122 upward towards the bubble rings 108. Flaps 124 are coupled by hinges 126 to the housing 120. Each of the flaps 124 has a membrane-forming ring 128 that engages a bubble ring channel 250 (FIG. 4) present in the bubble ring 108.

When the fan 122 is controllably and intermittently activated, air is blown into and through the housing 120 and onto the flaps 124. The flaps are of sufficient weight to close when air is not blowing past them, but readily open when the fan 122 blows air through the housing 120. When bubble solution is present in the associated bubble rings 108 and the associated bubble ring channels, and the flaps 124 pivot away from the bubble rings 108 upon the hinges 126, the bubble solution adhering to the membrane-forming rings 128 causes the membrane to form across the bubble rings 108. The membrane formed across the bubble rings 108 serves as the origin for the bubbles 102 that form when air is blown through the bubble rings 108. As the membrane may be ruptured from time to time, the intermittent activity of the fan 122 periodically allows the flaps 124 to close across the top of the housing 120. This causes the membrane-forming rings 128 to engage the bubble rings 108 and their bubble ring channels to recreate the membranes across the bubble rings 108 once the fan 122 begins again to blow air through the housing 128.

Figure 2:
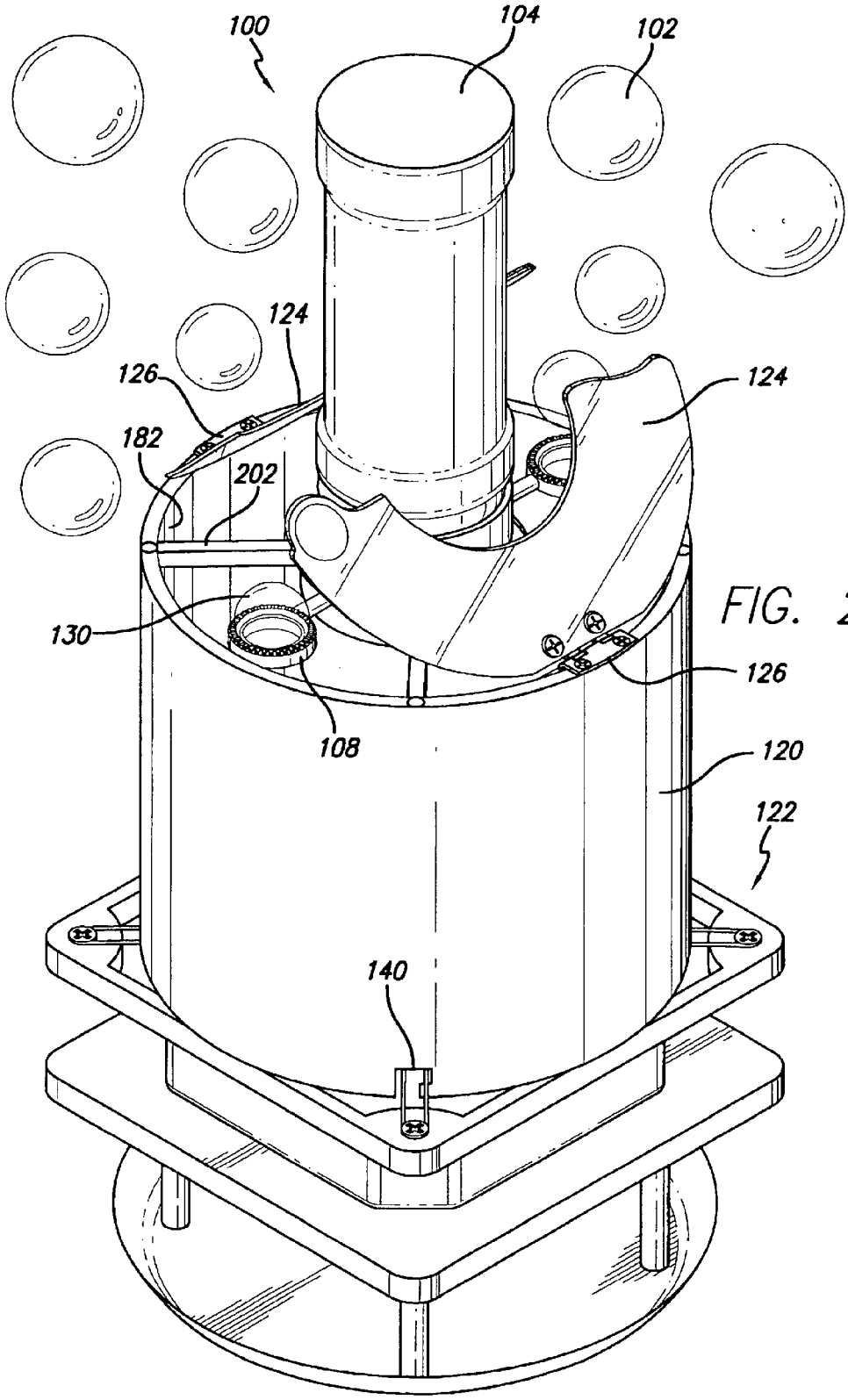
FIG. 2 is a top side perspective view of the bubble machine of FIG. 1 with the flaps open and bubbles being created from the bubble rings.

FIG. 2 shows the formation of bubbles 102 from a membrane 130. Note should be taken with respect to the angle that the flaps 124 take with respect to the housing 120. It has been found that by allowing the flaps 124 to pivot upon the hinges 126 to a nearly vertical position forces the bubbles 102 generally to strike the refillable bottle 104. Consequently, the flaps 124 are disposed so that they are at an acute angle with respect to the top of the housing 120. This angled disposition of the flaps 124 serves to direct the air blown by the fan 122 away from the bubble-making machine 100 and into the adjoining area.

Note should also be taken that the housing 120 generally enjoys a bayonet-type of connection 140 with a portion of the fan framework system 122.

Figure 5:
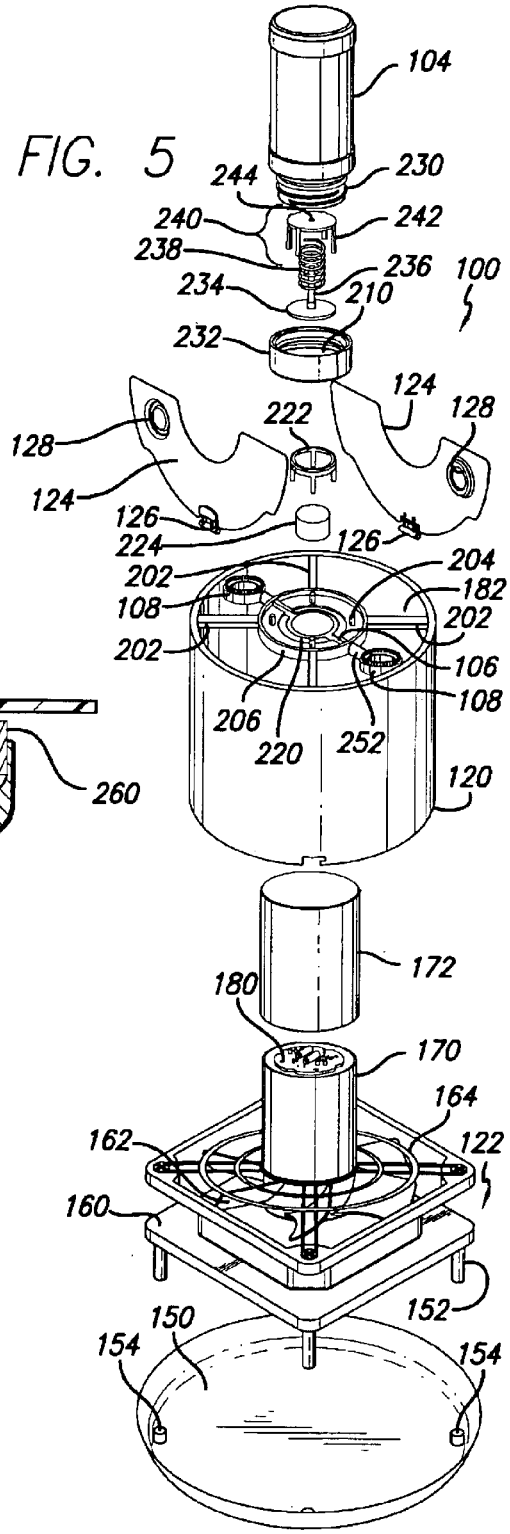
FIG. 5 is an exploded view of the bubble machine shown in FIG. 1.

FIG. 5 shows an exploded view of the bubble-making machine of the present invention. Note should be taken that the view shown in FIG. 5 is only one embodiment of the present invention and many alternative embodiments may be achieved with respect to the membrane-forming aspects of the present invention, such as the membrane-forming rings 128, as well as the circuitry or mechanism causing the intermittent formation of a membrane 130 across the bubble rings 108.

As is shown in FIG. 5, the bubble-forming machine 100 has a drip tray 150 in which the fan 122 may sit. The legs 152 of the fan 122 may fit into sockets 154 from which the legs 152 are removed with some effort, but the legs 152 are generally not permanently attached to the sockets 154 in order to allow for easy cleaning of the drip tray 150. The fan 122 generally has a substantial chassis 160 that encloses a fan blade 162 attached to a motor (not shown). To protect the fan blade 162 from objects and such objects from the fan blade 162, a protective grillwork 164 is attached to the top of the fan chassis 160.

To promote a modular construction technique as well as providing for an attractive appearance, the batteries, motor, and intermittent circuit are centrally disposed above the fan 122 in a central pillar 170. This central operation pillar 170 is generally less than the height of the housing 120 and is protected by a pillar cover 172. Preferably, the pillar cover 172 forms a water-tight connection with the fan chassis 160 or grillwork 164 to protect the circuitry 180 (FIGS. 6 and 7), the batteries (not shown) and the motor (not shown). If such a water-tight connection is present, the detachment of the housing 120 from the bayonet connection with the protective grillwork 164 allows the fan 122 and central operation pillar 170 to be rinsed as under a faucet in an easy and convenient manner. Generally, while bubble solution is not unsanitary, it is sticky and slick, and people generally prefer to have clean surfaces with which to work. Additionally, the sticky surface of the soap may attract dirt or the like, which over time may become unattractive or distasteful.

The housing 120 may be cylindrical in nature and sit atop the fan chassis 160 as by bayonet connection 140 with the protective grillwork 164 of the fan 122. The housing 120 is generally hollow save for its opening 182 at its top, where the reservoir 106 is centrally disposed in the opening 182 and held in place there by lateral supports 202. The reservoir 106 contains small offsetting supports 204 that support the refillable bottle 104 above the surface of the central reservoir 106. The top of the small offset supports 204 is below the top of the side 206 of the central reservoir 106.

The small offset supports 204 provide space through which bubble solution from the refillable bottle 104 may flow, yet the opening to the refillable bottle 104 is effectively closed by bubble solution held by the reservoir 106, as the opening 210 to the refillable bottle 104 is held beneath the surface of the bubble solution in the reservoir 106, which is held in the reservoir by the side 206 of the reservoir 106. In the interior of the reservoir 106 are a number of channels 220, which serve to guide the flow of bubble solution out to the soap bubble rings 108. They may also provide a support for a float cage 222, which provides an operating space for a magnetic or other type of float 224. The height of the float cage 222 is significantly higher than that of the magnetic float 224 to allow it to move upward.

The magnetic float 224 provides an indicator as to the presence of bubble solution in the reservoir 106 and bottle 104. When the level of liquid is sufficiently high, the magnetic float 224 floats up and away from the bottom of the reservoir 106. The upward travel of the magnetic float is constrained by the float cage 222, which prevents the magnetic float 224 from moving away from its central location in the reservoir 106. The diameter of the float cage 222 is generally sufficiently smaller than that of the bottle opening 210, so that it can fit through the bottle opening 210 and into the bottle 104. As is described in more detail below, the float cage 222 serves to open the bottle 104 when it is fitted about the float cage 222 and set into place over the reservoir 106.

The refillable bottle 104 generally has a threaded end 230, which threadably engages a lid 232 that has a central opening 210 that acts as the opening to the bottle 104. A stopper 234 is centrally disposed in the opening 210 to prevent the outflow of bubble solution from the bottle 104. The stopper 234 has a central shaft 236 that extends away from the stopper 234 and into the interior of the bottle 104.

A spring 238 acts against the stopper 234 and a stopper cage 240 which is attached by legs 242 to the lid 232. A central aperture 244 in the stopper cage 240 allows the travel of the central shaft 236 therethrough and allows the stopper 234 to be displaced by the float cage 222 when the bottle 104 is placed into position upon the reservoir 106. The spring 238 is generally one that is weak in character or in "springiness." However, it is sufficient to provide an adequate seal for the stopper 234 against the lid 232. When the bottle is in the upright position, the spring 238 holds the stopper 234 in place against the lid 232, so that bubble solution does not splash out. The seal that forms between the stopper 234 and the lid 232 is sufficient to prevent the outflow of such bubble solution.

When the bottle 104 is turned upside down (as is true immediately prior of the placement of the bottle 104 upon the reservoir 106), the biasing force of the spring 238 is further augmented by the weight of the bubble solution. The pressure of the bubble solution upon the stopper 234 additionally increases the closing force present between the stopper 234 and the lid 232. When the bottle 104 is placed over the float cage 222, the weight of the bottle 104 with however much or however little bubble solution it has is sufficient to overcome both the biasing force of the spring 238 and the weight of the bubble solution contained in the bottle 104. The lid of the bottle 232 slips around the float cage 222 until the descent of the bottle 104 is stopped when the lid 232 comes into contact with the small offset supports 204.

Upon the opening of the stopper 234 from the bottle opening 210 present in the lid 232, the bubble solution flows out of the bottle 104 until the level of the bubble solution rises to approximately the level of the opening 210 to the bottle 104. This level is determined by the small offset supports 204 and is below the height provided by the side 206 of the reservoir 106. Once the level of the bubble solution of the reservoir 106 rises to the level of the opening 210 to the bottle 104, air cannot flow into the bottle 104 through the opening 210. This prevents further outflow of the bubble solution into the reservoir 106, as such outflow must be replaced by the inflow of another fluid, namely air, into the bottle 104. This operation is similar to that of a water cooler that maintains a reservoir of water above the level of the opening to the upside-down water bottle. Until the water level outside the opening sufficiently descends below the opening, no outside air can travel into the bottle to allow the outflow of additional water from the bottle.

Figure 3:
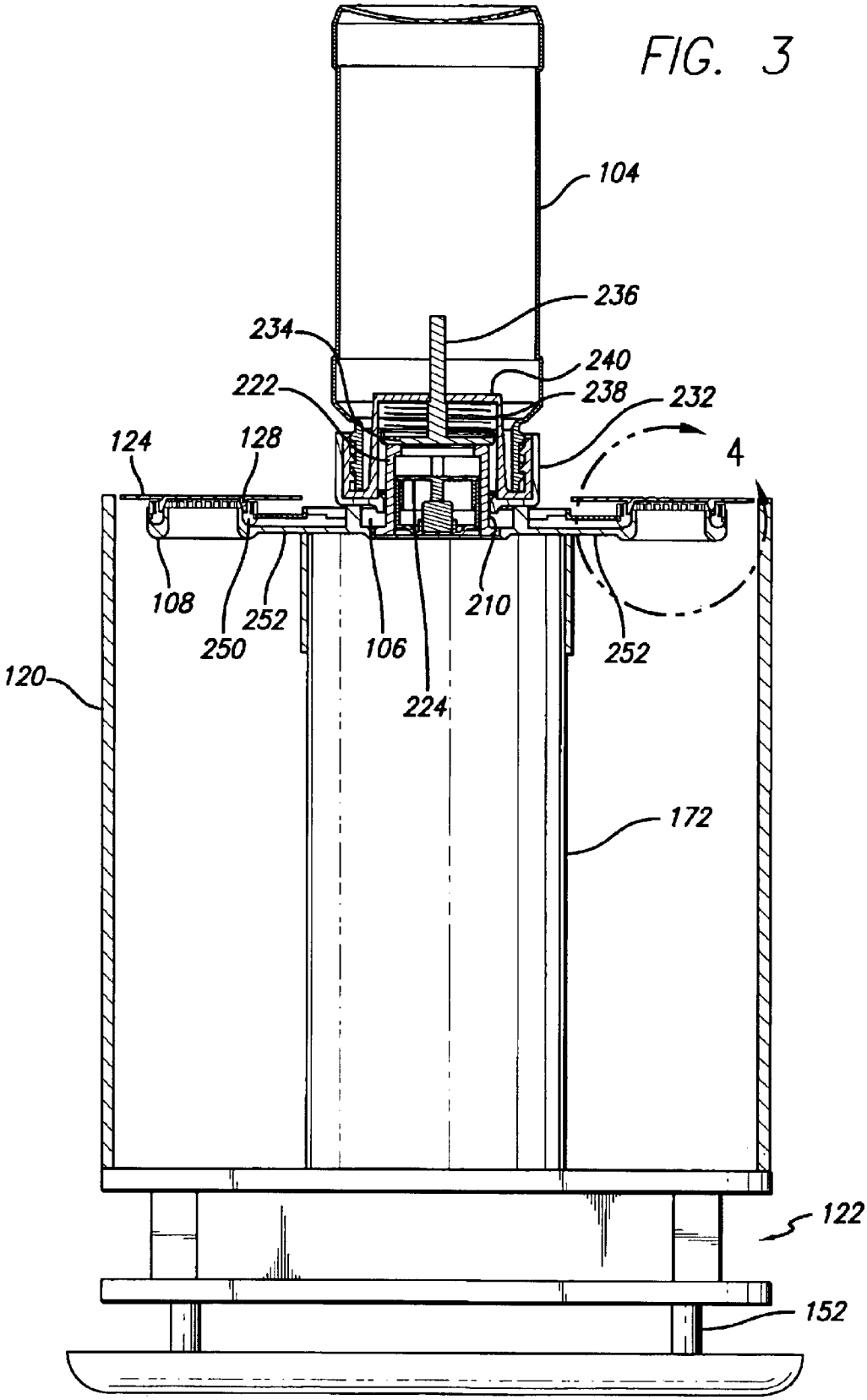
FIG. 3 is a cross-section view of the bubble machine in FIG. 1 taken along line 3—3.

In operation, the engagement of a bottle 104 with the reservoir 106 as well as the membrane-forming rings 128 with the bubble rings 108 is shown in cross-section, or assembly view, in FIG. 3. Close inspection of FIGS. 3 and 5 will provide an excellent indication of the construction of the present invention.

Critical to the present invention is the manufacturing of bubbles. Without the manufacture of bubbles 102, the present invention does not achieve its great utility and entertainment value. As a result of long experimentation, the inventor found that bubble formation by the bubble ring 108 would sometimes cease due to rupture of the bubble solution membranes. It then became a challenge to find a way to provide the continuous or on-going creation of bubbles for a vertically-dispensing bubble machine. As mentioned above, many prior devices used horizontal bubble making systems so a bubble ring or wand could be dipped into a bubble solution reservoir. That alternative was not available in the present invention, as there is no way to conveniently dip a bubble wand into a bubble solution reservoir as the bubble wand has to be disposed in a flat, or horizontal, manner in order to create vertical bubbles.

After much thought and deliberation, the inventor achieved the present invention by creating means that not only periodically re-formed a membrane across the bubble ring 108, but dispersed the bubbles 102 created by the bubble ring 108 away from the bubble machine 100, so that the bubble machine 100 itself did not cause the destruction of the bubbles it made.

Figure 4:
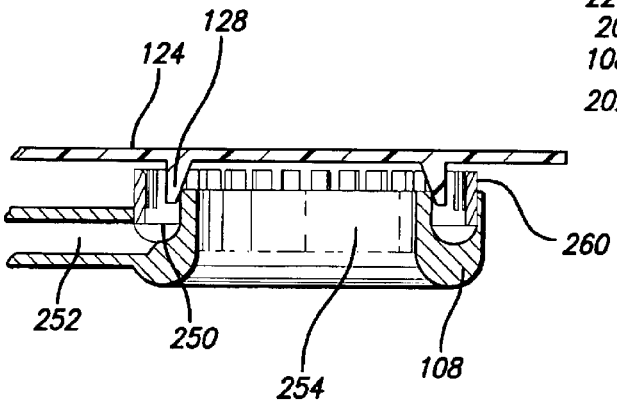
FIG. 4 is a close-up view of the bubble ring channel, and membrane-forming ring shown in circle 4 of FIG. 3.

Turning now to FIG. 4, an enlarged cross-section of the bubble ring shown in FIG. 3 at circle 4 indicates the mechanical architecture used to achieve the present invention. The bubble ring 108 has a bubble ring channel 250 connected to the central reservoir 106 by a bubble channel arm 252. The bubble channel arm may be connected or in communication with the reservoir channels 220 and serves as a hollow support by which the bubble rings 108 may be supported as well as supplied with bubble solution from the central reservoir 106. The bubble solution flows from the central reservoir 106 into the bubble arms 252 and on to the bubble ring channels 250. Gravity flow is responsible for the communication of bubble solution from the refillable bottle 104 to the reservoir 106 to the bubble rings 108. Upon encountering the bubble ring channel 250, the bubble solution distributes itself about the bubble ring channel 250, which circumscribes the central aperture 254 of the bubble ring.

It can be seen that, while bubble solution is available to the bubble ring 108 when the refillable bottle 104 supplies bubble solution to the reservoir 106, a means must be present by which a membrane 130 can be formed across the central bubble ring aperture 254. The membrane-forming ring 128 is that thing which creates the membrane 130.

When the bubble solution flows into the bubble ring channel 250, it comes into contact with the surface of the membrane-forming ring 128. It also comes into contact with all of the other surfaces of the bubble ring 108 adjacent the bubble solution. These surfaces include the toothed ring 260, which by surface tension and adhesion serve to lift the bubble solution up from the bubble ring channel 250. Additionally, when the membrane-forming ring 128 is in place, a seal is formed by contact between the bubble ring 108 and the membrane-forming ring 128 as shown in FIG. 4.

Upon coming into contact with the surfaces present in the bubble ring channel 250, the bubble solution is then ready to be used to form bubbles. Upon activation of the fan, air pressure is increased upon the flap 124 which then lifts up and away from the housing opening 182, which lifts the membrane-forming ring 128 up and away from the bubble ring 108. Due to surface tension, bubble solution is drawn away from the top of the bubble ring by the withdrawing of the membrane-forming ring 128 from the bubble ring 108, thus forming a tubular film of bubble solution between the bubble ring 108 and the membrane forming ring 128. At some point, this tubular film naturally pinches off forming a closed membrane. Continuous bubble formation occurs as air pressure elongates the membrane to the point where it pinches off forming a spherical bubble and leaving behind a closed membrane. Toothed ring 260 helps stabilize the bubble solution film during this process. Bubble solution in the bubble ring channel 250 lost to bubble egress is replenished by gravitational flow from the central reservoir 106.

Consequently, the formation of bubbles enables the formation of additional bubbles as the creation of bubbles does not necessarily destroy the membrane 130 present across the central aperture 254 of the bubble ring 108. Only when that membrane 130 is lost are bubbles no longer created. To prevent interruption of the bubble making process, the flap 124 periodically descends down to the housing opening 182 so that the membrane-forming ring 128 can engage the bubble ring channel 250 and the bubble solution therein. The process is then repeated with the lifting of the flap 124 and withdrawal of the membrane-forming ring 128 to ensure ongoing creation of a new set of bubbles.

While it is in the contemplation of the present invention to have a sensitive mechanism as to whether or not a membrane 130 is present across the central aperture 254 of the bubble ring 108, one economy can be achieved by using an intermittent fan system whereby mere timing is used to assure that a membrane 130 is always present across the central aperture 254. The mechanism to periodically re-establish the membranes 130 may be powered by several batteries and may be either electronic/pneumatic or mechanical in nature. A mechanical system would generally have a number of cams and/or gears and could make the bubble making machine 100 of the present invention more frail, complicated, subject to breakage and/or noisier. Consequently, the electronic circuit embodiment for the control of the fan shown in FIG. 6 is currently believed to be a preferable embodiment.

As shown in FIG. 6, the fan 122 is showed connected by a relay switch 280 to a timing circuit. A series of three switches 282, 284, 286 are shown which control the operation of the fan and the availability of voltage from the battery 288 to the circuit. Capacitor C2, 290 generally controls the operation of a commonly-known 555 timer chip 292. In order to precharge the timing capacitor 290, a charging circuit 294 is used. As those who have ordinary skill in the art will understand the operation and construction of the circuit set forth in FIG. 6, a detailed description is not set forth herein as being redundant and readily available elsewhere. However, the charging circuit 294 charges the capacitor C2/290 until capacitor C3/296 is saturated.

In so providing a charging circuit 294, the duration of the OFF state which would initially result from the connection of the three switches 282, 284, 286 is reduced, and the operation of the fan begins much sooner than if the charging circuit 204 were absent.

In combination, resistor R1/300 and resistor R2/302 set the ON time for the fan, while the resistance of resistor R2/302 sets the fan OFF time. In the present invention, a timing series circuitry of initial OFF state of 5 seconds (to provide the initial flow of bubble solution to the bubble rings 108) is then followed by a series of 8 seconds with the fan ON, 3 seconds with the fan OFF, and so on. The initial pause in the fan's operation after the magnetic float 224 has been lifted from the reservoir 106 is then followed by a regular series of 8 seconds of the fan being ON with 3 seconds of the fan being OFF.

The 3 switches S1/282, S2/284, and S3/286 shown in FIGS. 6 and 7 must all be on in order for the circuitry to be powered and the fan to run. Switch S1/282 is a tilt switch that is only ON when the central operation pillar is in an upright and vertical position. The second switch S2/284, the magnetic float switch, is in an OFF position when the magnetic float 224 rests upon the central reservoir 106. This magnetic float switch 284 then turns on when the magnetic float 224 floats above the reservoir 106 as when it floats in the bubble solution present in the reservoir 106 and bottle 104. The third switch S3/286 is also a magnetic switch that is in the OFF position when the housing 120 has not been properly fitted in bayonet-type connections 140 with the protective grillwork 164. Two magnets 310 (not shown) are disposed near the top of the housing 120. The magnets are so disposed that no matter which way the housing 120 is connected to the fan 122, proper connection of the housing 120 to the fan 122 disposes the magnets 310 in a proper position so as to turn the housing assembly switch S3/286 into an ON position. Consequently, not only must the bubble machine 100 of the present invention be in an upright position, but it must also have bubble solution in the reservoir 106 and the housing 120 must be properly connected to the fan 122 in order for the fan 122 to operate.

FIG. 7 shows silhouettes of circuit elements actually used to achieve the intermittent timing portion of the circuitry shown in FIG. 6.

Many variations on the present invention will be easily achieved by those with ordinary or other skill in the art. Particularly, the membrane 130 may be formed across the bubble rings 108 by wiper or the like in the form of a wire or otherwise as is known in the art. Additionally, a mechanical switch can be used to deactivate the fan upon disassembly with correspondingly proper modifications made to the intermittent circuitry 320 shown in FIGS. 6 and 7.

While the present invention has been described with regards to particular embodiments, it is recognized that additional variations of the present invention may be devised without departing from the inventive concept. One such alternative embodiment would be to provide a downward cascade of bubbles using the present invention. Instead of the air blowing upwardly through the bubble rings 108, air could be blown downwardly through a bubble ring and bubble solution supply system as described herein to create a column, a curtain, or an entire fall of bubbles.

What is claimed is:

1. A machine for making bubbles comprising:

a housing;

a fan operatively coupled to said housing;

a bubble loop oriented in a substantially horizontal plane and subject to air blown in a substantially vertical direction from said fan, said bubble loop including a structural element in the form of a ring surrounding an open air passageway and a channel adapted to contain liquid bubble solution, said channel capable of delivering liquid bubble solution all the way around said bubble loop;

a liquid bubble solution supply supplying said bubble loop with bubble solution; and a membrane-forming member forming liquid bubble solution membrane across said air passageway of said bubble loop.

2. The machine for making bubbles of claim 1 wherein:

said liquid bubble solution supply including an inverted bottle type fluid delivery system adapted to maintain a fluid level such that liquid bubble solution is supplied to but does not overflow said channel in said bubble loop during normal use.

3. The machine for making bubbles of claim 2 wherein:

said inverted bottle type fluid delivery system comprises a removable bottle adapted to contain liquid bubble solution.

4. The machine for making bubbles of claim 3 wherein:

said inverted bottle type fluid delivery system further comprises a cap and valve assembly attached to said bottle and a projection connected to said housing configured such that while said bottle is separated from the rest of said machine for making bubbles, said cap and valve assembly seals said bottle and while said bottle is properly installed, said projection causes said valve to open thereby allowing liquid bubble solution to exit said bottle and air to enter.

5. The machine for making bubbles of claim 3 further comprising:

a float-activated on/off switch including a float, said float-activated on/off switch configured in such a way that while said bottle is properly installed and said bottle contains more than a minimum amount of liquid bubble solution said float floats on liquid bubble solution supplied by said bottle and causes said on/off switch to be in the "on" state.

6. The machine for making bubbles of claim 5 wherein:

said float-activated on/off switch comprises a permanent magnet and a magnetic reed switch.

7. The machine for making bubbles of claim 5 further comprising:

a tilt switch, said tilt switch preventing said fan from operating while said machine for making bubbles is not in a substantially upright orientation.

8. The machine for making bubbles of claim 6 wherein:

said machine for making bubbles may be disassembled into a first part including said permanent magnet and a second part including said magnetic reed switch.

9. The machine for making bubbles of claim 8 further comprising:

an assembly switch, said assembly switch preventing said fan from operating while said machine for making bubbles is in a disassembled state.

10. The machine for making bubbles of claim 1 wherein:

said membrane-forming member is powered by air pressure from said fan.

11. The machine for making bubbles of claim 10 further comprising:

a controller, said controller having a first sate in which power is not supplied to said fan and a second state in which power is supplied to said fan, said controller being capable of operating in a cyclic manner alternating between said first state and said second state.

12. The machine for making bubbles of claim 11 wherein:

an initial first state after said machine for making bubbles is turned on is sufficient in duration to allow said liquid bubble solution supply to supply liquid bubble solution to said bubble loop; and durations of said second states and said first states subsequent to said initial first state are sufficient to allow said membrane-forming member to form a membrane across said air passageway.

13. The machine for making bubbles of claim 1 wherein:

said membrane-forming member includes a pull-away member configured to contact liquid bubble solution within said channel so that as said pull-away member is pulled away from said channel, a tubular film of liquid bubble solution is drawn from said channel which, upon reaching a certain length, naturally pinches off to form a closed membrane across said air passageway of said bubble loop.

14. The machine for making bubbles of claim 13, wherein said membrane-forming member further comprises:

a hinged flap coupled to said pull-away member, said hinged flap subject to air blown from said fan, said hinged flap being biased toward a first closed position while said fan is off and biased toward a second open position while said fan is on; whereby said pull-away member may contact liquid bubble solution in said channel while said hinged flap is in said first closed position.

15. A bubble solution supply system for a machine that makes bubbles, the machine having a housing and a channel supplying a bubble loop with bubble solution, the bubble solution supply system comprising:

a valveless inverted bottle type fluid delivery system adapted to automatically maintain a fluid level such that liquid bubble solution does not overflow the channel during normal use, said fluid delivery system including a liquid bubble solution container, said fluid delivery system restricting air flow to said container to prevent excessive outflow of liquid bubble solution from said container.

16. The bubble solution supply system of claim 15 wherein:

said inverted bottle type fluid delivery system comprises a removable bottle adapted to contain liquid bubble solution.

17. The bubble solution supply system of claim 16 wherein:

said inverted bottle type fluid delivery system further comprises a cap and valve assembly attached to said bottle and a projection coupled to the housing configured in such a way that when said bottle is separated from the rest of said machine for making bubbles, said cap and valve assembly seals said bottle and when said bottle is properly installed, said projection causes said valve to open thereby allowing liquid bubble solution to exit said bottle and air to enter.

18. The bubble solution supply system of claim 16 further comprising:

a float-activated on/off switch configured in such a way that while said bottle is properly installed and said bottle contains more than a minimum amount of liquid bubble solution, said float causes said on/off switch to be in an "on" state.

19. The bubble solution supply system of claim 18 wherein:

said on/off switch comprises a permanent magnet and a magnetic reed switch.

20. A membrane-forming member for forming liquid bubble solution membranes across an air passageway of a bubble loop, wherein said membrane-forming member is powered by air pressure from a fan blowing air through said a passageway and is adapted to intermittently engage said bubble loop due to air pressure from said fan.

21. The membrane-forming member of claim 20, further comprising:

a controller operatively coupled to the membrane-forming member, said controller having a first state in which power is not supplied to said fan and a second state in which power is supplied to said fan, said controller being capable of operating in a cyclic manner alternating between said first state and said second state.

22. The membrane-forming member of claim 21 wherein:

an initial first state of said controller is sufficient in duration to allow liquid bubble solution from a supply of liquid bubble solution to flow to the bubble loop to supply initial liquid bubble solution to the bubble loop; and a duration of said second states and said first states subsequent to said initial first state are sufficient to allow the membrane-forming member to form a membrane across the air passageway.

23. A membrane-forming member for forming liquid bubble solution membranes across an air passageway of a bubble loop having a channel holding liquid bubble solution, comprising:

a pull-away member configured to contact liquid bubble solution within the channel such that as said pull-away member is pulled away from the channel, tubular film of liquid bubble solution is drawn from the channel which, upon reaching a certain length, naturally pinches off to form a closed membrane across the air passageway of the bubble loop; and a hinged flap coupled to said pull-away member, said hinged flap susceptible to air blown from a fan, said hinged flap being biased toward a first closed position while said fan is off and biased toward a second open position while said fan is on; whereby said pull-away member is mounted on said hinged flap in such a way that said pull-away member may contact liquid bubble solution in the channel while said hinged flap is in said first closed position.

24. A bubble-making machine for making bubbles vertically dispensed, comprising:

a housing;

a fan operatively coupled to said housing for blowing air in an upward direction;

a first bubble ring operatively positioned within said housing and being superpositioned to said fan and subject to air blown by said fan;

a bubble solution supply coupled to said first bubble ring to supply said first bubble ring with bubble solution; and a membrane-forming ring intermittently engaging said first bubble ring and said bubble solution to aid in formation of bubbles; whereby bubbles may be formed in an ongoing manner by air traveling through said first bubble ring.

25. A bubble-making machine for making bubbles vertically dispensed as set forth in claim 24, further comprising:

said membrane-forming ring withdrawing from said first bubble ring when said fan blows air.

26. A machine for making bubbles as set forth in claim 24, further comprising:

a first hinged flap incorporating said membrane-forming ring, said first hinged flap hingedly attached to said housing and pivotably retreating from said first bubble ring and withdrawing said membrane-forming ring from said first bubble ring when said fan blows air through said first bubble ring.

27. A machine for making bubbles as set forth in claim 26, further comprising:

said hinged flap pivotably opening to a predetermined angle when subjected to air blown by said fan, said predetermined angle aiding in carriage of bubbles from said first bubble ring.

28. A machine for making bubbles as set forth in claim 24, further comprising:

a controller, said controller coupled to and intermittently activating said fan to control activity of said fan; whereby said membrane-forming ring intermittently engages said first bubble ring to ensure formation of a membrane from which bubbles may be continually formed.

29. A machine for making bubbles as set forth in claim 28, said controller further comprising:

a tip-over switch, said tip-over switch coupled to said fan and turning said fan off when the machine for making bubbles strays from an approximately upright position.

30. A machine for making bubbles as set forth in claim 28, said controller further comprising:

an intermittent activation system coupled to and intermittently activating said fan, said intermittent activation system intermittently ceasing operation of said fan until said membrane-forming ring engages said first bubble ring to ensure continual formation of bubbles.

31. A machine for making bubbles as set forth in claim 24, said bubble solution supply further comprising:

a reservoir for holding bubble solution, said reservoir coupled to said first bubble ring and providing a path for said bubble solution to said first bubble ring.

32. A machine for making bubbles as set forth in claim 31, said bubble solution supply further comprising:

a float cage present in said reservoir; and a float restrained by said float cage and coupled to said fan, said float activating said fan when floating in said reservoir.

33. A machine for making bubbles as set forth in claim 32, said bubble solution supply further comprising:

a bottle, said bottle for holding bubble solution; and a spring-biased lid threadably attachable to said bottle, said spring-biased lid having a movable stopper panel for allowing egress of bubble solution to said reservoir, said movable stopper panel urged to a closed state by a spring and opened by said float cage when said bottle with said lid is turned upside-down and placed into position about said float cage and above said reservoir; whereby bubble solution may be continuously fed into said reservoir by said bottle without overflow or spillage until a volume of bubble solution held by said bottle is depleted and said float is floatably lifted by said bubble solution to activate said fan.

34. A machine for making bubbles as set forth in claim 32, said float further comprising:

a magnetic float.

35. A machine for making bubbles as set forth in claim 24, further comprising:

said housing directing air blown by said fan to said first bubble ring and preventing dispersion of said fan-blown air away from said first bubble ring.

36. A machine for making bubbles as set forth in claim 35, further comprising:

a housing switch coupling said housing to said fan, said housing switch preventing operation of said fan unless said housing is properly in place.

37. A machine for making bubbles as set forth in claim 36, further comprising:

said housing coupled to said fan by a bayonet connection.

38. A bubble-making machine for making bubbles vertically dispensed, comprising:

a fan for blowing air in an upward direction;

a housing operatively coupled to said fan, said housing directing air blown by said fan and preventing dispersion of said fan-blown air;

a first bubble ring operatively positioned within said housing and being superpositioned to said fan and subject to air blown by said fan;

a bubble solution supply coupled to said first bubble ring to supply said first bubble ring with bubble solution, said bubble solution supply including:

a reservoir for holding bubble solution, said reservoir coupled to said first bubble ring and providing a path for said bubble solution to said first bubble ring;

a float cage present in said reservoir;

a magnetic float restrained by said float cage and coupled to said fan, said magnetic float activating said fan when floating in said reservoir;

a container, said container for holding bubble solution; and a spring-biased lid threadably attachable to said container, said spring-biased lid having a movable stopper panel for allowing egress of bubble solution to said reservoir, said movable stopper panel urged to a closed state by a spring and opened by said float cage when said container with said lid is turned upside-down and placed into position about said float cage and above said reservoir; whereby bubble solution may be limitedly but continuously fed into said reservoir by said container without overflow or spillage until a volume of bubble solution held by said container is depleted, said magnetic float floatably lifted by said bubble solution to activate said fan;

a membrane-forming ring, said membrane-forming ring initially engaging said first bubble ring and said bubble solution, said membrane-forming ring withdrawing from said first bubble ring when said fan blows air to aid in formation of bubbles;

a first hinged flap incorporating said membrane-forming ring, said first hinged flap hingedly attached to said housing and pivotably retreating from said first bubble ring and withdrawing said membrane-forming ring from said first bubble ring when said fan blows air through said first bubble ring, said hinged flap pivotably opening to a predetermined angle when subjected to air blown by said fan, said predetermined angle aiding in carriage of bubbles from said first bubble ring;

a controller, said controller coupled to said housing and said reservoir, said controller intermittently activating said fan to control activity of said fan so that said membrane-forming ring intermittently engages said first bubble ring to ensure formation of a membrane from which bubbles may be continually formed, said controller comprising:

a tip-over switch, said tip-over switch coupled to said fan and turning said fan off when the machine for making bubbles strays from an approximately upright position;

an intermittent activation system coupled to and intermittently activating said fan, said intermittent activation system intermittently ceasing operation of said fan until said membrane-forming ring engages said first bubble ring to ensure continual formation of bubbles;

a magnetic housing switch coupling said housing to said fan, said magnetic housing switch preventing operation of said fan unless said housing is properly in place; and a magnetic float switch coupled to said magnetic float and coupled to said fan, said magnetic float switch turning said fan off when said magnetic float is not floating; whereby said tip-over switch, said magnetic airflow channel switch, and said magnetic float switch must all be on for said fan to activate and for bubbles to be formed; whereby bubbles may be formed in an ongoing manner by air traveling through said first bubble ring upon provision of bubble solution to said reservoir.

39. A machine for making bubbles, comprising:

a fan, said fan blowing air in an upward direction;

a first bubble ring subject to air blown by said fan; and a retracting lip, said retracting lip engaging said first bubble ring, said retracting lip withdrawing from said first bubble ring to aid in formation of bubbles, said retracting lip withdrawing from said first bubble ring when said first bubble ring is subjected to air blown by said fan; whereby upon provision of bubble solution to said first bubble ring, bubbles may be formed in an ongoing manner by air traveling through said first bubble ring.

40. A machine for making bubbles as set forth in claim 39, further comprising:

a first hinged flap incorporating said retracting lip, said first hinged flap retreating from said first bubble ring and withdrawing said retracting lip from said first bubble ring when said fan blows air through said first bubble ring.

41. A machine for making bubbles as set forth in claim 40, said first hinged flap further comprising:

said hinged flap opening to a predetermined angle when subjected to air blown by said fan, said predetermined angle aiding in carriage of bubbles from said first bubble ring.

42. A machine for making bubbles as set forth in claim 39, further comprising:

said retracting lip being a membrane-forming ring.

43. A machine for making bubbles as set forth in claim 39, further comprising:

a controller, said controller coupled to and intermittently activating said fan; whereby said retracting lip intermittently engages said first bubble ring to ensure formation of a membrane from which bubbles may be formed.

44. A machine for making bubbles as set forth in claim 43, said controller further comprising:

a tip-over switch, said tip-over switch coupled to said fan and turning said fan off when the machine for making bubbles strays from an approximately upright position.

45. A machine for making bubbles as set forth in claim 43, said controller further comprising:

an intermittent activation system coupled to and intermittently activating said fan, said intermittent activation system intermittently ceasing operation of said fan until said retracting lip engages said first bubble ring to ensure continual formation of bubbles.

46. A machine for making bubbles as set forth in claim 39, further comprising:

a reservoir, said reservoir coupled to said first bubble ring and providing a path for said bubble solution to said first bubble ring.

47. A machine for making bubbles as set forth in claim 46, further comprising:

a float cage present in said reservoir; and a float restrained by said float cage and coupled to said fan, said float activating said fan when floating in said reservoir.

48. A machine for making bubbles as set forth in claim 47, said float further comprising:

a magnetic float.

49. A machine for making bubbles as set forth in claim 39, further comprising:

an airflow channel directing air blown by said fan to said first bubble ring and preventing dispersion of said fan-blown air away from said first bubble ring.

50. A machine for making bubbles as set forth in claim 49, further comprising:

an airflow channel switch coupling said airflow channel to said fan, said airflow channel switch preventing operation of said fan unless said airflow channel is properly in place.

51. A machine for making bubbles, comprising:

a fan, said fan for blowing air upwardly;

first and second bubble rings subject to air blown by said fan;

an airflow channel directing air blown by said fan to said first and second bubble rings and preventing dispersion of said fan-blown air away from said first and second bubble rings, said airflow channel having an airflow channel magnet that enables activation of said fan when said airflow channel is properly in place;

first and second membrane-forming rings, said first membrane-forming ring engaging said first bubble ring and said second membrane-forming ring engaging said second bubble ring, said first and second membrane-forming rings respectively withdrawing from said first and second bubble rings to aid in formation of bubbles, said first and second membrane-forming ring respectively withdrawing from said first and second bubble rings when said first and second bubble rings are subject to air blown by said fan;

first and second hinged flaps coupled by first and second hinges to said airflow channel on opposite sides thereof, said first and second hinged flaps respectively incorporating said first and second membrane-forming rings, said first and second hinged flaps pivotably retreating from said first and second bubble rings and respectively removing said first and second membrane-forming rings from said first and second bubble rings when said fan blows air upon said first and second bubble rings, said first and second hinged flaps opening to a predetermined angle when subject to air blown by said fan, said predetermined angle aiding in carriage of bubbles away from said first and second bubble rings;

a controller, said controller coupled to and intermittently activating said fan so that said first and second membrane-forming rings intermittently engage said first and second bubble rings, respectively, to ensure formation of membranes from which bubbles may be formed, said controller including:

a tip-over switch, said tip-over switch coupled to said fan and turning said fan off when the machine for making bubbles strays from an approximately upright position;

an intermittent activation system coupled to and intermittently activating said fan, said intermittent activation system intermittently ceasing operation of said fan until said first and second membrane-forming rings respectively engage said first and second bubble rings;

a magnetic airflow channel switch coupled to said fan and turning said fan off when said airflow channel switch is off; and a magnetic float switch coupled to said fan and turning said fan off when said magnetic float switch is off; whereby said tip-over switch, said magnetic airflow channel switch, and said magnetic float switch must all be on for said fan to activate;

a reservoir, said reservoir coupled to said first and second bubble rings by respective first and second paths for enabling respective bubble solution flow to said first and second bubble rings, said reservoir having a float cage; and a magnetic float restrained by said float cage and coupled to said fan, said float activating said fan by turning on said magnetic float switch when floating in said reservoir; whereby upon provision of bubble solution to said reservoir, bubbles may be formed in an ongoing manner by air traveling through said first and second bubble rings.

52. A machine for making bubbles as set forth in claim 51, further comprising:

a bottle, said bottle for holding bubble solution; and a spring-biased lid threadably attachable to said bottle, said spring-biased lid having a movable stopper panel for allowing egress of bubble solution to said reservoir, said movable stopper panel urged to a closed state by a spring and opened by said float cage when said bottle with said lid is turned upside-down and placed into position about said float cage and above said reservoir; whereby bubble solution may be continuously fed into said reservoir by said bottle without overflow or spillage until a volume of bubble solution held by said bottle is depleted and said float is floatably lifted by said bubble solution to activate said fan.

* * * * *